United States Patent [19]

Whan

[11] Patent Number: 4,646,877

[45] Date of Patent: Mar. 3, 1987

[54] WHEELED SCAFFOLD FOR WORKMEN AND BUILDING MATERIAL

[75] Inventor: Douglas Whan, Calgary, Canada

[73] Assignee: Whandering Metal Industries Ltd., Calgary, Canada

[21] Appl. No.: 774,612

[22] Filed: Sep. 10, 1985

[30] Foreign Application Priority Data

Sep. 10, 1984 [CA] Canada ..... 462818

[51] Int. Cl.[4] ..... E04G 3/12

[52] U.S. Cl. ..... 182/38; 182/45; 182/129

[58] Field of Search ..... 182/36, 38, 45, 115, 182/129

[56] References Cited

U.S. PATENT DOCUMENTS

| | | | |
|---|---|---|---|
| 1,070,156 | 8/1913 | McFarland | 182/36 |
| 1,160,721 | 11/1915 | Kessler | 182/38 |
| 2,985,253 | 5/1961 | Hollingsworth | 182/36 |
| 4,048,924 | 9/1977 | Wibben | 182/38 |
| 4,074,789 | 2/1978 | Warren | 182/37 |
| 4,132,287 | 1/1979 | Parolini | 182/45 |

FOREIGN PATENT DOCUMENTS

| | | | |
|---|---|---|---|
| 47804 | 4/1978 | U.S.S.R. | 182/45 |

*Primary Examiner*—Reinaldo P. Machado
*Attorney, Agent, or Firm*—Rogers, Bereskin & Parr

[57] ABSTRACT

A wheeled scaffold for roofing materials has a framework for carrying the roofing materials. The framework includes a row of steps extending along the framework. First and second wheels are secured to the framework. The first wheels support the framework on roof purlins, while the second wheels are arranged to run along the upper side of the roof purlins. The first and second wheels can be adjusted to accommodate different spacings of the roof purlins. Work platforms are secured to a side of the framework, to enable a person to secure roofing materials in position without leaving the scaffold.

17 Claims, 5 Drawing Figures

FIG. 4
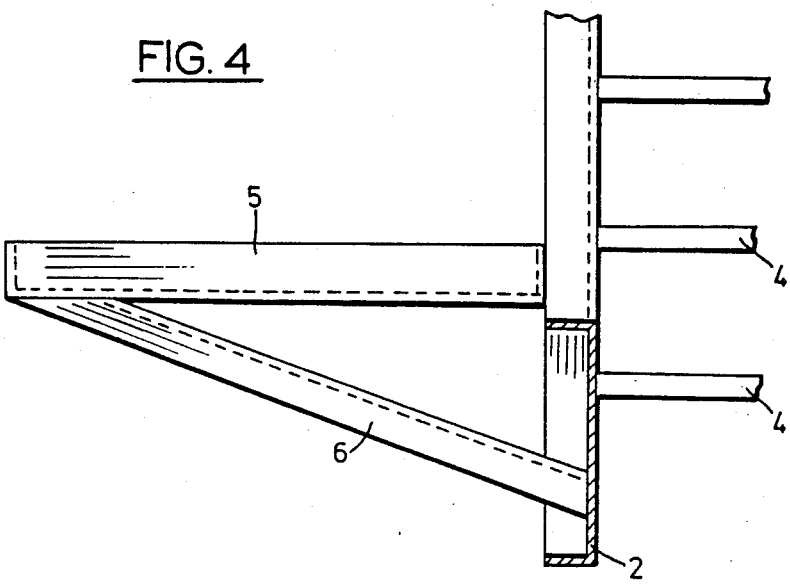
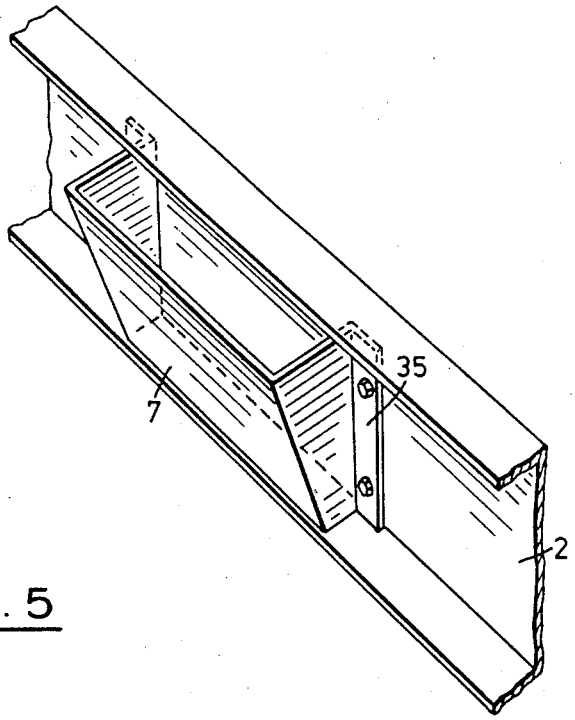
FIG. 5

WHEELED SCAFFOLD FOR WORKMEN AND BUILDING MATERIAL

This invention relates to a wheeled scaffold for building materials, such as roofing sheets.

One type of building construction, which is commonly used for large industrial buildings, comprises a steel frame to which panels are secured. Such a construction enables a durable structure to be erected quickly. However, problems have arisen with the attachment of the roofing sheets or panels to the frame. To secure these panels to the roof, the panels are first placed on the roof portion of the frame by a crane. Then, they are manouevered by hand into position and then bolted or otherwise secured to the frame. Each sheet is quite large, and a considerable amount of manpower is required to position and secure all the sheets. Furthermore, in strong winds manhandling these sheets on a roof which initially only comprises an open framework can be dangerous. Since the installers frequently stand on laid roofing panels, they frequently become marked or scratched. In particular, protective finishes can be damaged.

In U.S. Pat. No. 4,048,924 there is disclosed a roofing system which incorporates a wheeled skeletal structure. The wheels of the skeletal structure are arranged, to run on horizontal roof purlins, and roofing panels are carried on this skeletal structure. However, this structure includes no provision for workers who have to manhandle the sheets, nor does it include any means for moving the skeletal structure along the roof purlins. It can not be used on building with a pitch of more than 4 on 12. Consequently, although the workers do not have to move the roofing panels so far, they still have to manoeuver the panels into position whilst maintaining their footing on the frame. Also, the skeletal frame or structure has to be pushed from one position to another, which again has to be done by the workers whilst maintaining their footing. Such an arrangement would be impractical for a large roof.

The following U.S. patents disclose wheeled structures for movement across an inclined roof surface and were considered during the preparation of this application:

U.S. Pat. No. 4,132,287 (Parolini);

U.S. Pat. No. 4,074,789 (Warren);

U.S. Pat. No. 1,160,721 (Kressler)

According to the present invention there is provided a wheeled scaffold for roofing materials, the wheeled scaffold comprising:

a framework suitable for carrying roofing materials and including a row of steps extending along the framework;

first wheels secured to the underside of the framework and capable of supporting the framework on horizontal roof purlins of a roof frame, for transverse movement across a roof frame, and second wheels secured to the framework and capable of running on upper free sides of the horizontal roof purlins, the first and second wheels being moveable on the framework so that the wheels can be adjusted for different spacings of the horizontal purlins;

and work platforms secured to a side of the framework to enable a person to secure roofing panels in position whilst remaining on the scaffold.

The wheeled scaffold can additionally include hand or electrically operated winches for moving the scaffold along the horizontal purlins. These winches are expected to be particularly useful for larger wheeled scaffolds. Also, an electrical supply line can be provided with outlets spaced along the length of the scaffold. This then provies accessable electrical supply outlets for electric hand tools without the necessity of having to run wires across the roof, which can be damaged and which can obstruct other work.

Batches or stacks of roof panels can be loaded on the wheeled scaffold of the present invention, and then these panels can be laid progressively across a roof. All, or nearly all of the work in manoeuvering and securing the panel can be carried out without workers having to leave the wheeled scaffold. The provision of steps extending the length of the scaffold enables operators to move readily from one position on the scaffold to another. The work platforms enable roofing panels to be secured in position, without the operators having to leave the scaffold. Thus, either light or heavy gauge roofing panels can be secured and sealed, without the workmen having to stand or work on the laid roofing panels, thereby preventing unnecessary damage to the roofing panels.

In comparison to known techniques, which do not use such a wheeled framework, the wheeled scaffold of the present invention enables a roof to be constructed more quickly and more safely. For example, using conventional methods, it takes about three hours to install a $10' \times 10'$ square of roofing, whereas utilizing the wheeled scaffold of the present invention such an area can be installed in one half to one hour. Also, the wheeled scaffold can be used on quite steep roofs, for example roofs having a slope of four on twelve or steeper.

For a better understanding of the present invention and to show more clearly how it may be carried into effect, reference will now be made, by way of example, to the accompanying drawings, in which an embodiment of the present invention is shown and in which:

FIG. 4 shows a horizontal view on an enlarged scale of a work platform marked IV in FIG. 2;

FIG. 5 shows a perspective view on an enlarged scale of a pocket for tools marked V in FIG. 1.

Figure 1:
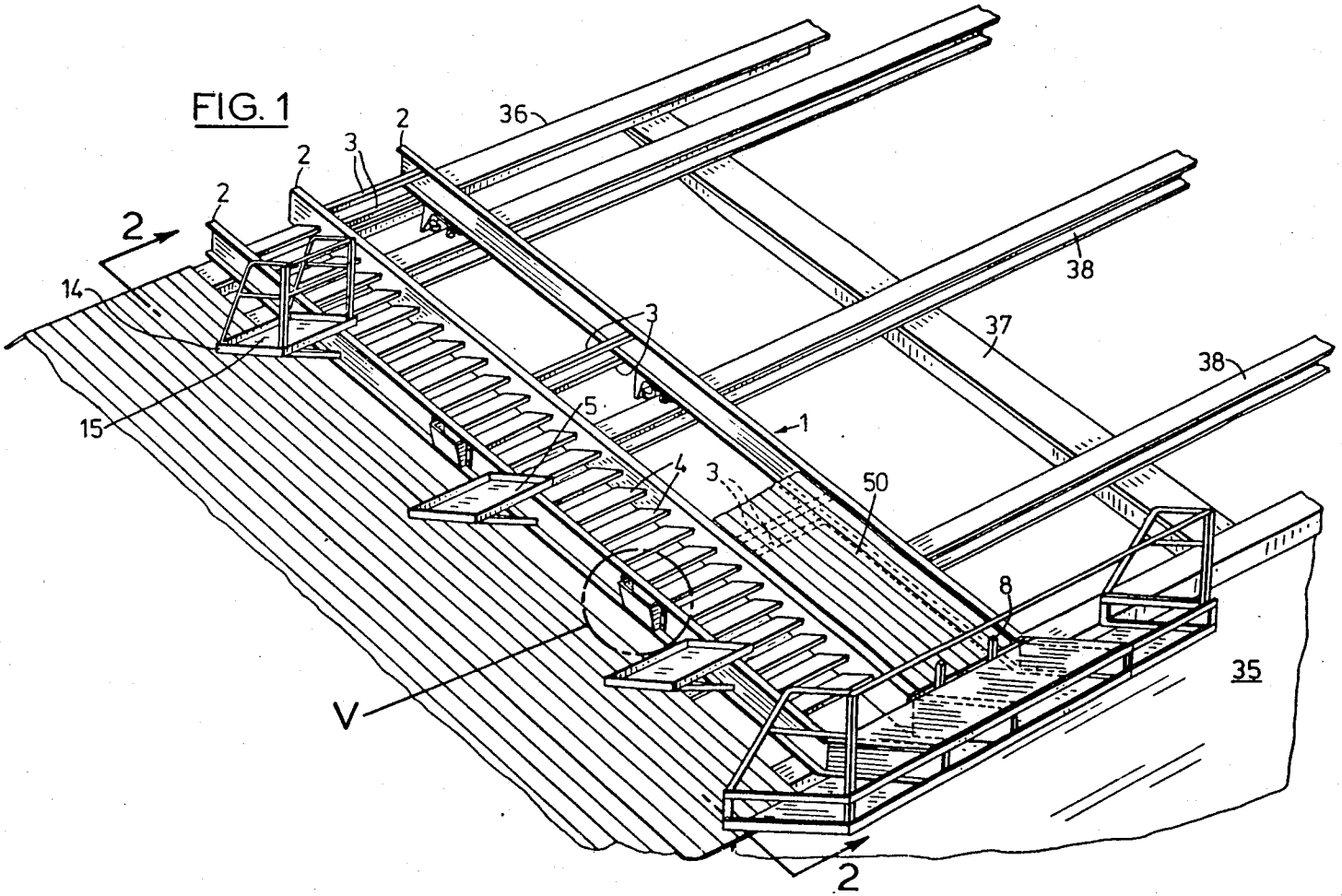
FIG. 1 shows a perspective view of a wheeled scaffold according to the present invention.

The wheeled scaffold comprises a framework 1, which includes three channel-shaped members 2 extending parallel to on another along its length. The central and right hand channel-shaped members 2 are secured together by crossbars 3. The central and left hand channel-shaped members 2 are secured together by individual steps 4, which make up a stairway or ladder extending up the left hand side of the scaffold. Work platforms 5 are secured to the left hand channel shaped member 2, and each includes support members 6 and 9 (See FIG. 2) which extend between an outer edge of a respective work platform 5 and the left hand channel shaped member 2. On the outside of the left hand channel shaped member 2, between the work platforms 5, there are pockets 7 for tools and the like.

The crossbars 3 are arranged in pairs. For each pair, one crossbar 3 extends between the upper flanges of the central and right hand members 2, whilst the lower crossbar 3 extends along the bottom of all three channel shaped members 2. As indicated at the bottom of the scaffold, vertical stops 8 can be provided for locating roofing panels 50 on the platform. The tops 8 prevent the roofing panels 50 from sliding downwards off the scaffold. Although not shown, additional stops 8 are provided for the other pairs of crossbars 3, or at other locations.

Figures 2, 3:
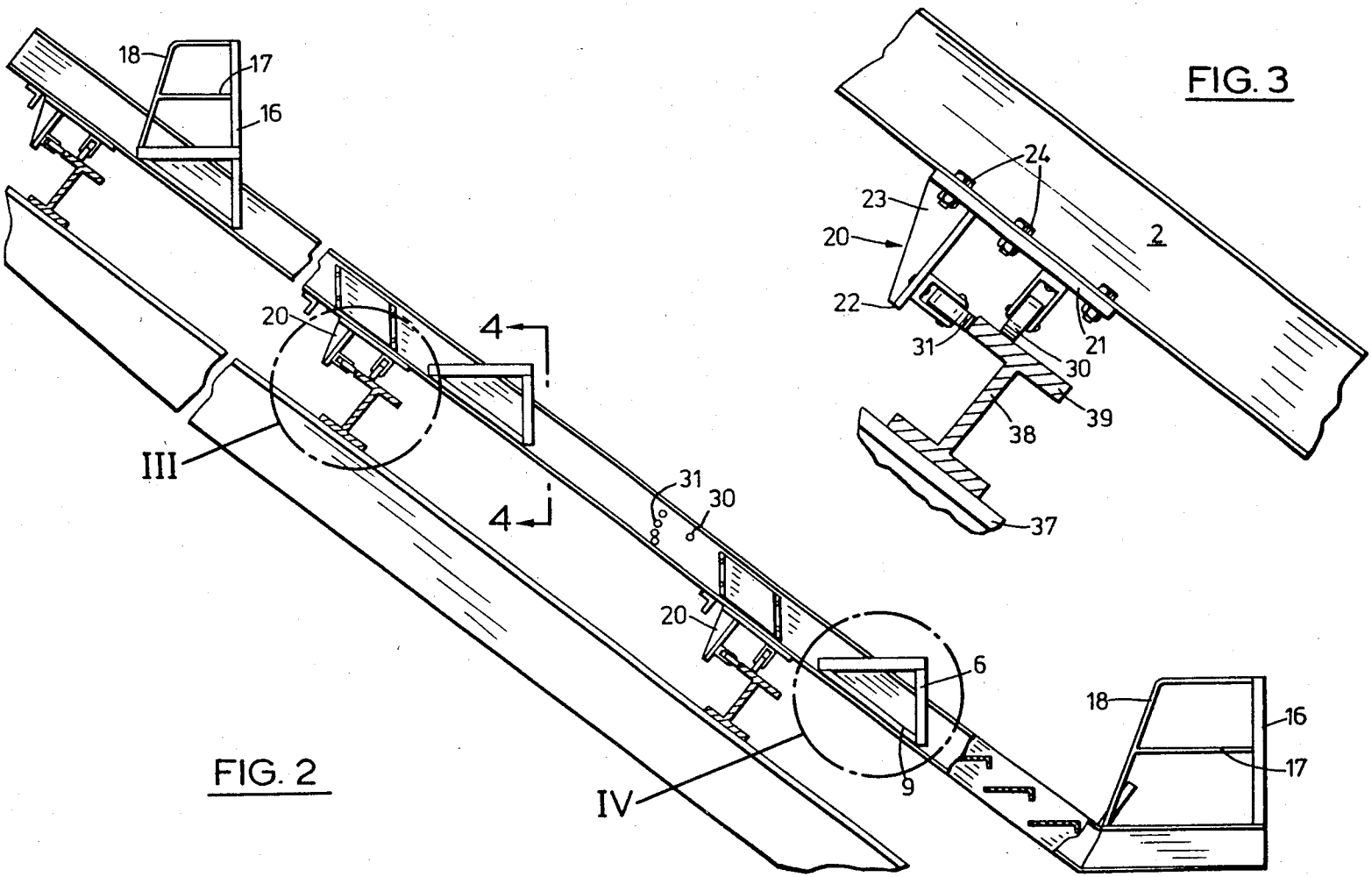
FIG. 2 shows a side view of the wheeled scaffold of FIG. 1.
FIG. 3 shows on an enlarged scale a wheel bracket marked III in FIG. 2, and a section through a horizontal purlin.

The work platforms 5 comprise a rectangular steel frame 14 on which a rectangular wooden plywood floor 15 is mounted As shown for the upper work platform shown in FIGS. 1 and 2, each work platform could be provided with a guide rail assembly, which has vertical steel uprights 16 at the rear. At the front, an inclined member 18 is provided, and cross members 17 extend between the uprights 16 and the inclined member 18. The members 17 and 18 are of lighter construction than the uprights 16. FIG. 4 shows a detail of one work platform 5. Each work platform 5 has two inclined supporting members 6 and 9 extending from a common point on the left hand channel shaped member 2 to outside corners of the work platform 5. The first member 6 extends to one outer corner of the work platform 5, whilst a second support member 9 (See FIG. 2) extends to the other outer corner of the work platform 5.

The framework 1 is adapted to run on horizontal roof purlins 38 of a roof frame. These horizontal purlins 38 are supported on inclined roof members 37, which extend from the top of sides 35 of a building to a ridge 36 of the roof. Other details of the building are not shown.

As shown in FIG. 2, wheel assemblies 20 are provided along the length of the left-hand channel-shaped member 2, and also along the right hand channel shaped member 2. The wheel assemblies 20 can also be provided on the central channel-shaped member 2. One wheel assembly 20 is shown in detail in FIG. 3. It has a generally L-shaped support portion, with a sheet base 21. Perpendicular to the base 21 and to each other are a first web portion 22 and a triangular web portion 23. A first wheel 30 is secured to the base 21, and a second wheel 31 is secured to the web portion 22. Both wheels 30 and 31 run on one horizontal roof purlin 38. The roof purlin 38 is an I beam with a top or outer flanged 39, although the scaffold will also run on a beam 38 of a channel iron or angle iron or formed as a round pipe. The first wheel 30 runs on this flange 39, whilst the second wheel 31 runs against an upper edge of the flange 39. For roofs with a shallow slope, the first wheels 30 bear most of the weight of the wheeled platform 1, and the second wheels 31 serve principally to locate the platform 1 on the horizontal roof purlins and to prevent the platform 1 moving down the slope of the roof. For steeply inclined roofs, a major part of the weight of the framework 1 might be carried by the second wheels 31.

The wheel assembly 20 is bolted to the channel shaped member 2 by bolts 24. In order to permit adjustment of the wheel assemblies 20 along the length of the channel shaped member 2, the bottom flange of the member 2 is provided with holes at, for example, 1" or 2" centres. Thus, the wheel assemblies 20 can be bolted at any position on a respective member 2, to suit various purlin spacings. Also, if desired or if necessary, shims can be used to obtain the required positions for the wheel assemblies 20.

Both the individual steps or treads 4 and work platforms 5 can be secured to the channel shaped members 2 in such a way that they can be rotated to a horizontal position, for any inclination of a roof. As shown in FIG. 2, a rear of a step can be secured by bolts or the like in openings 30 in the centre and left hand members 2. For each of the centre and left hand channel shaped members 2, there is a series of openings 31 on an arc centered on a corresponding opening 30. The front of that step 4 can then be secured by bolts passing through appropriate ones of the openings 31, so that the step 4 is horizontal. To align a step 4, the bolts in the openings 31 have to be removed, whereas the bolts in the openings 30 only need to be loosened to permit rotation of that step 4. Thus, the steps 4 can be adjusted without any danger of losing or dropping a step 4 and whilst maintaining the integrity of the framework 1. A similar provision can be provided for the work platforms 5. Each work platform 5 can have one permanent mounting point around which it can be rotated. A number of further mounting points are additionally provided, to enable the work platform 5 to be mounted at different angles.

FIG. 5 shows a detail of one tool holder 7. It is made of galvanized sheet metal, which is formed into a U-shape with mounting flanges 35. The mounting flanges 35 are screwed or otherwise fastened to the vertical web of the left hand channel-shaped member 2. A bottom of the tool holder 7 is formed by part of the bottom flange of the channel shaped member 2. A tool holder 7 can be pressed just above each work platform.

The framework 1 could additionally include one or more clamps for clamping the wheeled scaffold to a roof frame. Each clamp can be integral with the L-shaped support portion of a wheel assembly 20, and can be arranged to clamp either side of a flange 39. Also, the wheeled scaffold includes hand or electric winches (not shown) for moving it across a roof frame.

Adjacent the work platforms 5 on the left hand channel shaped member 2, electrical outlets can be provided. For convenience and to eliminate the necessity for excessive lengths of electric flex, four electrical outlets can be provided on each section of the wheeled scaffold, i.e. between each pair of work platforms 5. All the electrical outlets can be connected to a common input which in use can be connected to a single heavy duty supply cable.

For different roofs, the wheeled scaffold can be made in different lengths. Either a number of sets of the channel shaped members 2 can be kept, each set being of standard length. Then, to assemble the wheeled scaffold 1 it is only necessary to select the appropriate set of channel-shaped members 2 and secure them to the other components of the wheeled scaffold 1. Alternatively, each channel-shaped member 2 can be assembled from two or more members to form a channel-shaped member of the required length.

In use, the frame of a building is assembled using known techniques. A wheeled scaffold 1 of appropriate length is then assembled, with the work platforms 5 and steps 4 set at the required angle. The wheel assemblies 20 are also fitted for the known spacing of the horizontal roof purlins 38. The wheeled scaffold 1 is then lifted onto the roof frame by means of a crane. It is lowered and guided into position so that it is supported by the wheel assemblies 20 on the horizontal roof purlins 38, as shown in FIG. 3. The correct positioning of the wheel assemblies is then checked, and if necessary any adjustments to the positions of the wheel assemblies is made. Such adjustment can be effected by lifting slightly a relevant portion of the wheeled scaffold 1. The wheeled scaffold 1 is preferably placed on the roof frame with its left hand side adjacent one end of the roof frame. Then, free ends of cables can be taken from the winches and attached to a far end of the roof frame. The right hand side of the wheeled scaffold 1 is then loaded with roofing panels 50.

To commence laying the panels 50, the wheeled scaffold 1 is positioned adjacent one end of the roof frame, with a space between the edge of the roof and the work platforms 5 equal to the width of the roofing panels 50. If provided, the clamps can then be used to clamp the wheeled scaffold and prevent unwanted movement. The installers or operators can then manoeuvre individual panels 50 across from the right hand side of the wheeled scaffold 1 onto the roof frame, to provide a row of panels 50 adjacent the edge of the roof. The panels can be fed into position under the framework 1. Preferably, a lowermost panel 50 of this row is positioned first, since each panel 50 is overlapped by the panel 50 above it in the row. The operators can then secure and seal this row of panels 50. This should be possible without further movement of the scaffold as it is only moved one or two inches ahead of the panels. The operators can then freely work on the laid panels 50 from the work platforms 5, so that the panels 50 are not damaged by the installers walking or standing on them. The panels 50 can be secured by bolts or screws and caulked or sealed in known manner.

The wheeled scaffold 1 is then moved to the right, again after releasing the clamp if necessary, until the work platforms 5 are spaced from the laid row of panels 50 by a space wide enough to accomodate a second row of panels 50. Again, the clamps, if provided, are clamped to flanges 39 to secure the wheeled scaffold 1 in position. A second row of panels 50 is then laid by maneouvering panels 50 from the right hand side of the wheeled scaffold 1 onto the roof frame. Again, if desired, the wheeled scaffold 1 can be moved back until the work platforms 5 are over the second row of panels 50, to enable the operators readily to secure and seal the panels 50 in position. Alternatively, the wheeled scaffold can be left in position with the work platforms 5 adjacent this second row of panels 50, whilst the operators secure and seal the panels 50.

This operational sequence is repeated for each row of panels between each sequence. The wheeled scaffold 1 is each time moved to the right by a distance equivalent to the panel width, by means of the winches which draw in their respective cables. When the wheeled scaffold 1 reaches the other edge of the roof, there will be a portion of the roof frame which is below the wheeled scaffold 1 and is therefore inaccessible. This portion, equivalent to a row or two of roofing panels 50, can only be covered by removing the wheeled scaffold 1. First sufficient panels 50 for this portion of the roof are unloaded from the wheeled scaffold 1 onto the finished part of the roof adjacent the wheeled scaffold 1. The wheeled scaffold 1 is then removed by a crane, and these panels 50 are positioned, secured and sealed in known manner. To position these final panels 50, the installers will only have to move them a relatively small distance, equivalent to a few two panel widths.

In a variation of the wheeled scaffold 1, it can be provided with, for example, four work platforms 5 per unit length of the scaffold corresponding to the panel length. In this case, only every fourth work platform 5 is provided with the railing formed by components 16, 17 and 18. Then, it is relatively easy for the installers standing on these fourth, railed work platforms 5 to manoeuver panels 50 from the right hand side of the wheeled scaffold 1 over the intervening work platforms onto the roof frame.

I claim:

1. A wheeled scaffold, for roofing materials, the wheeled scaffold comprising:

a framework suitable for carrying roofing materials and including a row of steps extending along the framework;

first wheels secured to the underside of the framework and capable of supporting the framework on horizontal roof purlins of a roof frame, for transverse movement across a roof frame, and second wheels secured to the framework and capable of running on upper free sides of the horizontal roof purlins, the first and second wheels being movable on the framework so that the wheels can be adjusted for different spacings of the horizontal purlins;

work platforms secured to a side of the framework to enable a person to secure roofing materials in position on the roof frame whilst remaining on the scaffold, and extending laterally out from the framework; and support members extending between the framework and the work platforms, to support fully the work platforms above an area of a roof.

2. A wheeled scaffold as claimed in claim 1, wherein the framework is provided with pockets for storing tools.

3. A wheeled scaffold as claimed in claim 1, which includes winches mounted on the framework for driving the wheeled scaffold across a roof frame.

4. A wheeled scaffold as claimed in claim 1, which includes at least one clamp mounted on the framework for clamping and securing the wheeled scaffold relative to a framework.

5. A wheeled scaffold, for roofing materials, the wheeled scaffold comprising:

a framework suitable for carrying roofing materials and including a row of steps extending along the framework, each of which steps is mounted by a respective mounting means to the framework, which mounting means enable the steps to be individually positioned generally horizontally irrespective of the pitch of a roof frame on which the wheeled scaffold is located;

first wheels secured to the underside of the framework and capable of supporting the framework on horizontal roof purlins of a roof frame, for transverse movement across a roof frame, and second wheels, secured to the framework and capable of running on upper free sides of the horizontal roof purlins, the first and second wheels being movable on the framework so that the wheels can be adjusted for different spacings of the horizontal purlins; and work platforms secured to a side of the framework and extending laterally out from the framework to enable a person to secure roofing materials in position on the roof frame whilst remaining on the scaffold, each work platform being mounted to the framework by a respective mounting means which enables that work platform to be individually positioned generally horizontally, irrespective of the pitch of a roof frame on which the wheeled scaffold is located.

6. A wheeled scaffold as claimed in claim 1 or 5, wherein the first and second wheels are provided in a plurality of wheel assemblies, each of which wheel assemblies includes at least one first wheel and at least one second wheel and is secured to the framework.

7. A wheeled scaffold as claimed in claim 6, wherein the wheeled assemblies comprise a generally L-shaped support portion having first and second sides, a first U-shape bracket secured to the first side with a first wheel rotatably mounted in the bracket and with the first side being secured to the framework, and a second U-shape bracket attached to the second side with a second wheel rotatably mounted in the second bracket.

8. A wheeled scaffold as claimed in claim 7, wherein the wheeled assemblies are attached to the framework by bolts and wherein the framework includes a plurality of uniformly spaced holes for said bolts to permit the location of the wheeled assemblies to be adjusted, corresponding to different spacings of horizontal roof purlins.

9. A wheeled scaffold, for roofing materials, the wheeled scaffold comprising:

a framework which comprises first, second and third elongate members, which extend parallel to one another and, in use, perpendicular to the horizontal roof purlins of a roof frame, with the second elongate member disposed centrally of the first and third elongate members, a row of steps extending along the framework and secured between the first and second elongate members, and cross members securing the second and third elongate members together, the framework being suitable for carrying roofing materials;

first wheels secured to the underside of the framework and capable of supporting the framework on horizontal roof purlins of a roof frame, for transverse movement across a roof frame, and second wheels secured to the framework and capable of running on upper free sides of the horizontal roof purlins, the first and second wheels being moveable on the framework so that the wheels can be adjusted for different spacings of the horizontal purlins; and work platforms secured to a side of the framework to enable a person to secure roofing materials in position on the roof frame whilst remaining on the scaffold.

10. A wheeled scaffold as claimed in claim 9, wherein the first and second wheels are provided in a plurality of wheel assemblies, each of which wheel assemblies includes at least one first wheel and at least one second wheel and is secured to the framework.

11. A wheeled scaffold as claimed in claim 10, wherein the wheeled assemblies comprise a generally L-shaped support portion having first and second sides, with the first side being secured to the framework and with the first wheel being rotatably attached to the first side and the second wheel rotatably attached to the second side.

12. A wheeled scaffold as claimed in claim 11, wherein the wheeled assemblies are attached to the framework by bolts and wherein the framework includes a plurality of uniformly spaced holes for said bolts to permit the location of the wheel assemblies to be adjusted, corresponding to different spacings of horizontal roof purlins.

13. A wheeled scaffold as claimed in claim 9, wherein the framework is provided with pockets for storing tools.

14. A wheeled scaffold as claimed in claim 9, which includes winches mounted on the framework driving the wheeled scaffold across a roof frame.

15. A wheeled scaffold as claimed in claim 9, which includes at least one clamp mounted on the framework for clamping and securing the wheeled scaffold relative to a framework.

16. A wheeled scaffold as claimed in claim 9, which includes stops secured to, and extending vertically above, the cross members, for locating roofing panels on the cross members.

17. A wheeled scaffold as claimed in claim 9 or 16, wherein a bottom platform is secured to ends of the elongate members and extends across the width of the wheeled scaffold.

* * * * *